United States Patent [19]

Krautsack

[11] 3,945,559

[45] Mar. 23, 1976

[54] HOLDERS HAVING FOLDABLE SHEET SUPPORT

[75] Inventor: Richard G. Krautsack, Arlington Heights, Ill.

[73] Assignee: The Cooperative Marketing Co., Elmhurst, Ill.

[22] Filed: Mar. 17, 1975

[21] Appl. No.: 559,167

Related U.S. Application Data

[63] Continuation-in-part of Ser. No. 464,855, April 29, 1974, Pat. No. 3,881,649.

[52] U.S. Cl. ..... 229/38; 40/10 R;12; 206/460

[51] Int. Cl.[2] ..... B65D 5/06

[58] Field of Search ..... 229/38 R, 48 SB, 43; 206/45.13, 44.12, 425, 460; 221/282; 40/10 R, 12

[56] References Cited

UNITED STATES PATENTS

| | | | |
|---|---|---|---|
| 1,282,814 | 10/1918 | Guedalia | 206/DIG. 20 |
| 2,142,194 | 1/1939 | Karfiol | 206/460 X |
| 2,146,420 | 2/1939 | Davidson | 206/45.12 |
| 2,770,411 | 11/1956 | Mackay | 229/43 |
| 3,130,833 | 4/1964 | Glasser et al. | 206/460 |
| 3,618,238 | 11/1971 | Willinger | 40/10 R |
| 3,753,305 | 8/1973 | Meuh | 40/12 X |
| 3,814,303 | 6/1974 | Smith | 229/38 R |

*Primary Examiner*—Davis T. Moorhead
*Attorney, Agent, or Firm*—Fitch, Even, Tabin & Luedeka

[57] ABSTRACT

A holder or the like for presenting an assemblage of items to be taken therefrom on a one-by-one basis including a foldable support sheet that can be attached to differently oriented surfaces. The sheet is composed of a lower main portion and an upper support portion including an attachment section and a connection section. Adhesive on the front surface of the attachment section and the rear surface of the connection section permits the connection section to be secured to the rear surface of the sheet and thus adapted for attachment to a forward-facing surface via the adhesive on said attachment section. The sheet can be folded differently and the holder attached to a pole or to a rearward-facing surface.

10 Claims, 9 Drawing Figures

HOLDERS HAVING FOLDABLE SHEET SUPPORT

RELATED APPLICATIONS

This application is a continuation-in-part of United States Patent application Ser. No. 464,855, filed Apr. 29, 1974, entitled "Folders Having Foldable Support", which issued on May 5, 1975, as U.S. Pat. No. 3,881,649.

BACKGROUND OF THE INVENTION

This invention relates to holders for dispensing sheet-like items and more particularly to improvements in holders of this type which facilitate mounting in several different ways. Few drugstores, grocery supermarkets and retail shops of this type in the United States do not contain various types of holders which display advertising material and the like at locations of convenience or of high traffic flow in order to catch the eye of the consumer. U.S. Pat. No. 2,755,576 is an example of one such advertising display device which carries a plurality of tear-off sheets in the form of a gummed pad attached to a backing sheet wherein the upper rear surface of the backing sheet is provided with a strip of pressure-sensitive adhesive designed to facilitate its mounting by pressing the adhesive-coated backing sheet against the front surface of the price channel of a supermarket shelf or the like.

SUMMARY OF THE INVENTION

The invention provides an improved holder for an assemblage of sheetlike items which is capable of being mounted in several different positions. More particularly, a foldable holder is provided which is designed to fit about and connect to a vertical pole, as well as to a flat surface like a wall and/or to a rearward-facing surface, such as the rear side of a depending price channel.

DETAILED DESCRIPTION OF THE PREFERRED EMBODIMENT

Figure 1:
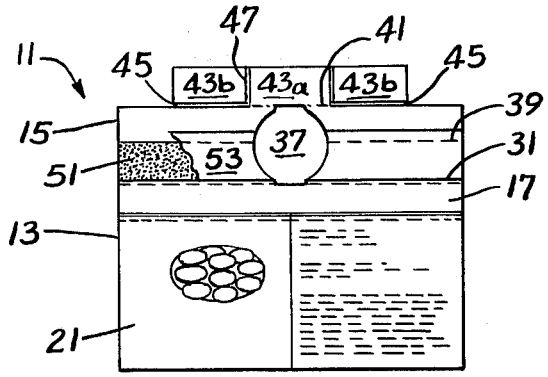
FIG. 1 is a front view of a holder embodying various features of the invention which carries a pad of advertising sheets.
Figure 2:
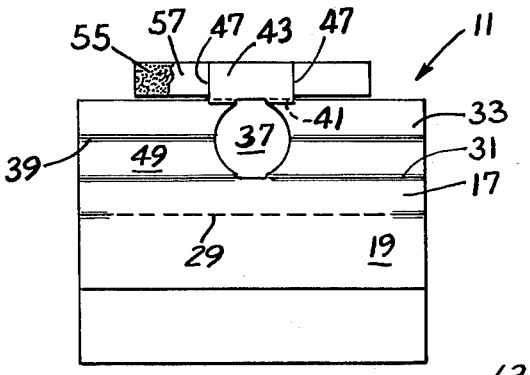
FIG. 2 is a rear view of the holder shown in FIG. 1.

The invention provides a versatile holder 11, depicted in FIGS. 1 and 2, which is simple in construction but which is capable of supporting an assemblage of sheetlike items by attachment to a vertical pole, a wall, or the rear surface of a depending element, such as the price channel on a grocery supermarket shelf. The holder is considered to have substantial advantage in the distribution of advertising material of various types, particularly order blanks for special offers, coupons, partial price return offers, recipes, applications for credit cards or loans, which are desirably located in high customer traffic areas; however, the invention may also have application in providing convenient mounting of assemblages of more standard items, such as telephone return call slips, memo paper and the like, in locations where they will be conveniently available when repeatedly needed. The assemblage of items for distribution or for any use may be single sheets, folded sheets or even thin booklets. Moreover, the items may be attached to one another at their upper edges in the form of a commonly used gummed pad, or they may be held loosely within an open top tray or pocket (not shown) which the holder may provide.

The holder 11 is a generally planar foldable sheet made of a suitable weight fiberboard material, or the like, which includes a main portion 13 and an upper support portion 15. In the illustrated embodiment, the main portion 13 includes an upper heading portion 17 and a lower portion 19 to which the pad of advertising sheets 21 is connected.

The illustrated assemblage of advertising display sheets 21 is held together by a suitable hot-melt padding adhesive 25 — the sheets 21 being attached to a backing sheet 27 by the padding adhesive 25, and the backing sheet 27 being appropriately adhesively attached to the lower portion 19 of the holder. However, it should be understood that the sheets 21 could be directly attached to the lower portion 19, and if desired, the portion 19 could be longer so as to extend the full height of the sheets 21. As best seen in FIG. 2, the line of demarcation between the upper heading portion 17 and the lower portion 19 can be provided with perforations 29 along a major central portion of its length so as to allow the holder to be folded substantially in half upon itself to facilitate easy packing for shipment.

The upper support portion 15 of the holder 11 is hinged to the main portion along a fold line 31 and includes an attachment section 33 which contains a generally centrally located aperture 37. The attachment section 33 is split in the middle by a parallel fold line 39 which intersects the aperture 37. A connection section 43 is hinged to the attachment section 33 along a line 41 parallel to the lines 31 and 39, the relatively short central portion of which line constitutes a folding or hinge section which is flanked by a pair of slits or cuts 45 of substantially equal length. The flanking slits 45 and a pair of perpendicular fold lines 47 divide the connection section 43 into a main portion 43a and flanking tab portions 43b.

Figure 3A:
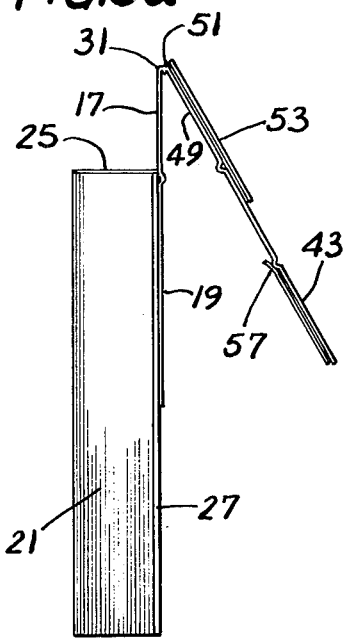
FIG. 3*a* is an enlarged side view showing the holder as it is being folded in preparation for attachment to a forward-facing surface.

As best seen perhaps in FIG. 3*a*, the region 49 of the attachment section 39 which lies between the fold lines 31 and 39 carries a layer 51 of pressure-sensitive adhesive upon its front surface, which layer is covered by a release liner 53, which in the illustrated embodiment extends past the fold line 33 to facilitate easy removal. As best seen perhaps in FIGS. 2 and 4*a*, the connection section 43 carries a layer 55 of pressure-sensitive adhesive upon its rear surface which is covered by release liner 57. Although the front surface of the region 49 and the rear surface of the section 43 are shown as being completely covered with pressure-sensitive adhesive, it should be understood that a lesser amount of the surface might be adhesively coated to achieve the desired objective.

Figure 3B:
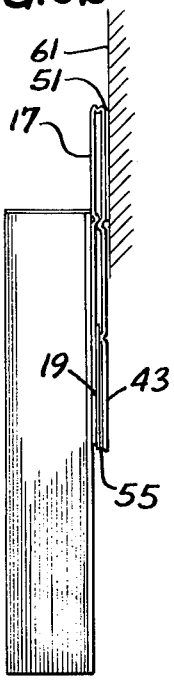
FIG. 3*b* shows the holder folded and attached to a wall.

FIGS. 3*a* and 3*b* illustrate the folding of the support portion 15 of the holder 11 in a manner to facilitate its attachment to a forward-facing surface, such as a wall 61 or the like. To achieve this configuration, the support portion 15 is first folded about the fold line 31 which defines the upper edge of the heading section 17, as depicted in FIG. 3*a*. The release liner 57 is removed to expose the pressure-sensitive adhesive 55 which coats the rear surface of the connection section 43. When folding is complete, the adhesive 55 bonds the connection section 43 to the rear surface of the lower portion 19, thus locking the holder in the doubled-over configuration depicted in FIG. 3b. Removal of the release layer 53 then allows the holder 11 to be pressed against the vertical surface of a wall 61 or the like, where the pad of sheets 21 will be held in hanging relationship thereupon.

Figure 4A:
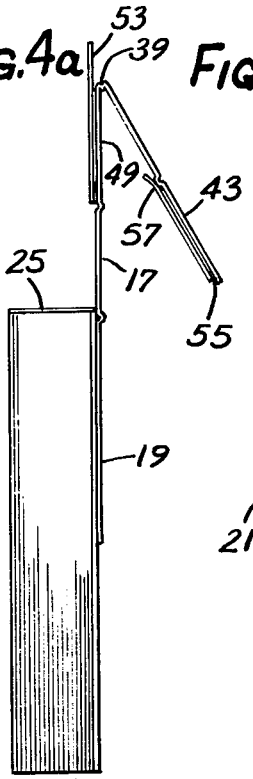
FIG. 4*a* is a side view, enlarged in size, showing the holder as it is being folded in preparation for attachment to a rearward facing surface.
Figure 4B:
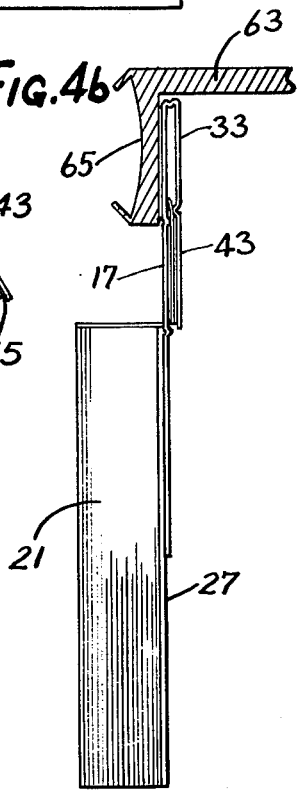
FIG. 4*b* shows the holder attached to the rear surface of a price channel.

FIGS. 4*a* and 4*b* depict the folding of the support portion 15 of the holder 11 in a manner to facilitate its attachment to the rear surface of the price channel 65 of a grocery supermarket shelf 63. The attachment section 33 is folded rearward in half upon itself along the fold line 39. The release liner 57 is removed, and the adhesive-coated rear surface of the connection section 43 is pressed against the rear surface of the heading portion 17, effecting adhesive joinder thereto. With the holder thus locked in the doubled-over configuration depicted in FIG. 4*b*, the release liner 53 is removed, and the holder is installed below the supermarket shelf 63 by simply pressing the adhesive-coated front surface of the attachment section 33 against the rear surface of the price channel 65.

Figure 5A:
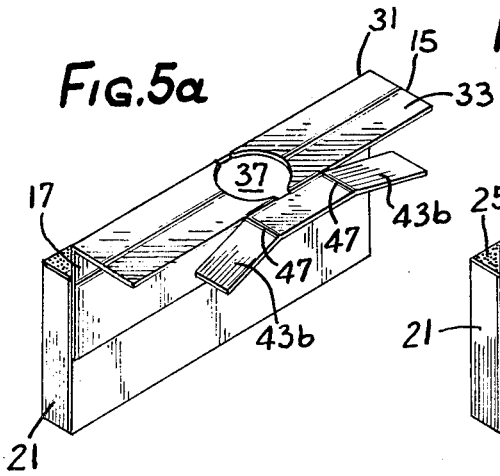
FIG. 5*a* is a perspective view showing the holder as it is being folded in preparation for attachment to a vertical pole.
Figure 5B:
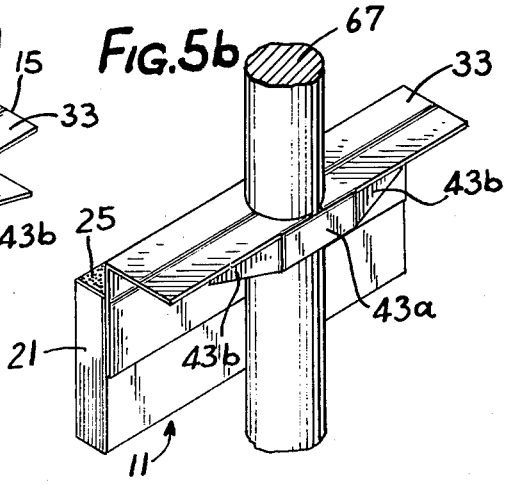
FIG. 5*b* shows the holder disposed upon the pole.
Figure 5C:
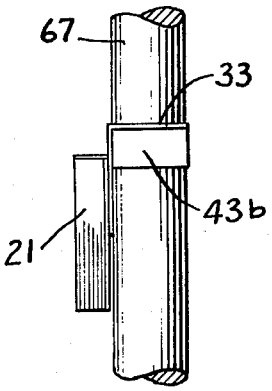
FIG. 5*c* is a side view showing the holder attached to the pole.

FIGS. 5*a*, 5*b* and 5*c* depict the mounting of the holder 11 to a vertical pole 67 or the like. Although the aperture 37 is generally circular and accordingly designed to accommodate a pole 67 of circular cross section, the aperture 37 could be contoured to accommodate a pole of substantially any cross sectional shape. The initial folding is depicted in FIG. 5*a* where the support portion 15 is folded rearward about 90° along the fold line 31, and the tab portions 43*b* of the connection section 43 are folded slightly downward along the perpendicular fold lines 47. The holder 11 is then installed on a suitable pole 67 by inserting the pole through the aperture 37.

The release liner 57 is then removed from the connection section 43, and with the holder located at the desired vertical level on the pole 67, the adhesive-coated surface of the central connection section 43*a* is pressed into contact with the rear of the pole. Thereafter, the tab portions 43*b* are pressed into contact with the side surfaces of the pole 67 to locate them as depicted in FIG. 5*c* with their upper and lower edges horizontal. As a result of this disposition, the edges of the tabs 43*b* which are defined by the slits 45 provide a planar support for the underside of the attachment section 33, thus providing a squared appearance from the side and a firm support on the pole as a result of attachment in three different planes. In the pole support disposition illustrated in FIGs. 5*a*, 5*c*, the adhesive coating on the attachment section 33 is not used and accordingly the release liner 53 is not removed.

The invention provides a holder of relatively simple design which can be shipped in substantially flat condition to users or to distribution points. Because of the versatility of its support arrangement, the holder can be employed without concern with regard to the type of shelves or display points available at its ultimate destination. Although some modifications have been mentioned throughout the specification, other modifications that would be obvious to one having the ordinary skill in this art should be understood as falling within the scope of the invention which is defined by the claims appended hereto. Various additional features of the invention are set forth in the claims that follow.

What is claimed is:

1. A holder or the like for presenting an assemblage of items to be taken therefrom on a one-by-one basis, which holder comprises a generally planar foldable support sheet having a plurality of parallel fold lines and first and second adhesive attachment means so disposed that said support sheet can be attached to differently oriented surfaces, said support sheet comprising a lower main portion and an upper support portion including an attachment section and a connection section, all of which are defined by said fold lines, said main portion being located at one end of said sheet and being designed to carry the assemblage of items, said attachment section being hinged to said main portion and said connection section being located adjacent the other end of said sheet, said first and second adhesive attachment means being disposed, respectively, upon the front surface of said attachment section and upon the rear surface of said connection section said sections being proportioned so that by folding said attachment section rearward about 180° and by connecting said connection section to one location on the rear surface of said sheet via said second adhesive attachment means, said holder is adapted for attachment to a forward-facing surface via said first adhesive attachment means, or alternatively by folding said support portion rearward in a different orientation, said holder is adapted for attachment to a differently oriented surface.

2. A holder in accordance with claim 1 wherein said attachment section contains an additional parallel fold line located generally medially therein so that, by folding said attachment section rearward upon itself about said additional fold line and by connecting said connection section to another location on the rear surface of said sheet, said holder is adapted for attachment via said first adhesive attachment means to a rearward-facing surface.

3. A holder in accordance with claim 2 wherein said adhesive attachment means comprises pressure-sensitive adhesive covered by a release liner.

4. A holder in accordance with claim 1 wherein said attachment section is formed with an aperture proportioned to fit about a pole and wherein said connection section is partially severed from said attachment section along said parallel fold line a distance sufficient to produce a tab portion hinged to the remainder of said connection section, which tab is adapted for orientation generally transverse to said remainder of said connection section to which it is hinged and for attachment to a pole received in said aperture via said second adhesive attachment means.

5. A holder in accordance with claim 4 wherein a pair of cuts are provided along said fold line between said attachment section and said connection section and extending inward from both ends to create a pair of tab portions which are hinged to the remaining central portion along lines substantially perpendicular to said parallel fold lines, so that when said attachment section is bent rearward about 90° and received upon a pole, said connection section is bent 90° downward to a generally vertical orientation and said pair of tab portions are bent inward and attached to the pole via said second adhesive attachment means, the edges of said tab portions formed by said cuts engaging the undersurface of said attachment section.

6. A holder in accordance with claim 5 wherein the ends of said tab portions are substantially perpendicular to said parallel fold lines and wherein said tab portions are of sufficient length so that said ends abut the rear surface of said main portion when the holder is attached to a pole.

7. A holder or the like for presenting an assemblage of items to be taken therefrom on a one-by-one basis, which holder comprises a generally planar foldable sheet having a plurality of parallel fold lines defining a main portion, an attachment section and a connection section which are serially connected to one another at said fold lines, adhesive attachment means being disposed upon the rear surface of said connection section, said attachment section being formed with an aperture proportioned to fit about a vertical pole and said connection section being severed from said attachment section along said parallel fold line a distance sufficient to produce a tab portion hinged to the remainder of said connection section which tab is adapted for orientation generally transverse to said remainder of said connection section to which it is hinged, whereby attachment to a pole received in said aperture is effected via said adhesive attachment means carried by said tab portion and by said remainder of said connection section.

8. A holder in accordance with claim 7 wherein a pair of cuts are provided along said fold line between said attachment section and said connection section and extending inward from both ends to create a pair of tab portions which are hinged to the remaining central portion along lines substantially perpendicular to said parallel fold lines, so that when said attachment section is bent rearward 90° and disposed about a pole, and when said connection section is bent 90° downward to a vertical orientation and when said pair of tab portions are bent inward and attached to opposite-facing surface portions of the pole via said adhesive attachment means, the edges of said tab portions formed by said cuts engage the undersurface of said attachment section and provide square support therefor.

9. A holder in accordance with claim 8 wherein the ends of said tab portions are substantially perpendicular to said parallel fold lines and wherein said tab portions are of sufficient length so that said ends abut the rear surface of said main portion when the holder is attached to a pole.

10. A holder in accordance with claim 7 wherein additional adhesive attachment means is disposed upon the front surface of said attachment section and wherein by folding said attachment section rearward about 180° and by connecting said connection section to one location on the rear surface of said sheet via said adhesive attachment means on said connection section, said holder is adapted for attachment to a forward-facing surface via said additional adhesive attachment means.

* * * * *